US005364298A

United States Patent [19]

Crisci et al.

[11] Patent Number: 5,364,298

[45] Date of Patent: Nov. 15, 1994

[54] TOY AIRPLANE LAUNCHER AND WINDER

[75] Inventors: Louis Crisci, Lindenhurst; Martin Mallin, Merrick, both of N.Y.

[73] Assignee: Lake Grove Toy Corporation, Lake Grove, N.Y.

[21] Appl. No.: 881,796

[22] Filed: May 12, 1992

Related U.S. Application Data

[63] Continuation-in-part of Ser. No. 755,091, Sep. 5, 1991, Pat. No. 5,129,852.

[51] Int. Cl.[5] ..... A63H 27/14; A63H 27/22

[52] U.S. Cl. ..... 446/59; 24/136 L

[58] Field of Search ..... 446/60, 59, 57, 64, 446/65, 459; 24/16 R, 136 R, 136 L, 130, 115 M

[56] References Cited

U.S. PATENT DOCUMENTS 1,565,437 12/1925 Greife ..... 446/65

3,905,711 9/1975 Rogers ..... 24/115 M X

FOREIGN PATENT DOCUMENTS 188645 1/1957 Austria ..... 24/136 L

*Primary Examiner*—Mickey Yu

*Attorney, Agent, or Firm*—Bryan, Levitin & Bab

[57] ABSTRACT

A toy airplane launcher apparatus includes a toy airplane having an electric or rubberband motor for rotating a prop which is rotatably mounted to the airplane. The launcher has a guide rail which slidably carries a rear launcher section which is slidable into engagement with a front launcher section engaged to the front end of the guide rail. Two rubberbands are engaged between the front and rear launcher sections to hold them together and for biasing the rear launcher section toward the front launcher section when the two are separated from each other. The rear launcher section is engagable with the trigger and is either fixed to or detachably engaged with the airplane. When the trigger is moved, the rear launcher section moves quickly along the rail into engagement with the front launcher section. If the rear launcher section is fixed to the airplane, both front and rear launcher sections leave the rail and are launched along with the airplane. If the rear launcher section is merely engaged with the airplane, the two launcher sections stay on the rail allowing the airplane to be launched along. A winder forms part of the launcher and either charges the power supply for the electric motor or winds the rubberband motor. Advantageously, the propeller is allowed to rotate only as or after it is launched.

7 Claims, 5 Drawing Sheets

FIG. 2a
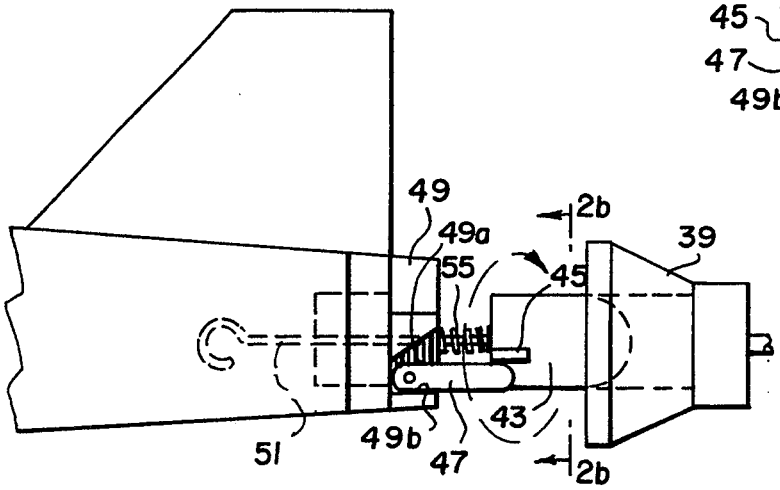
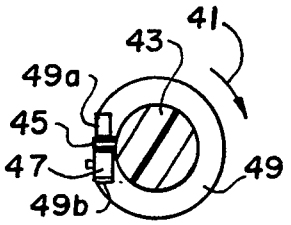
FIG. 2b
FIG. 2c
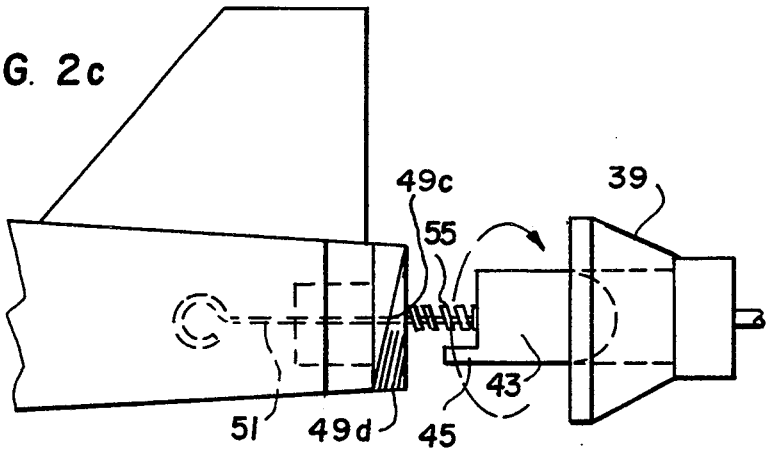
FIG. 4a
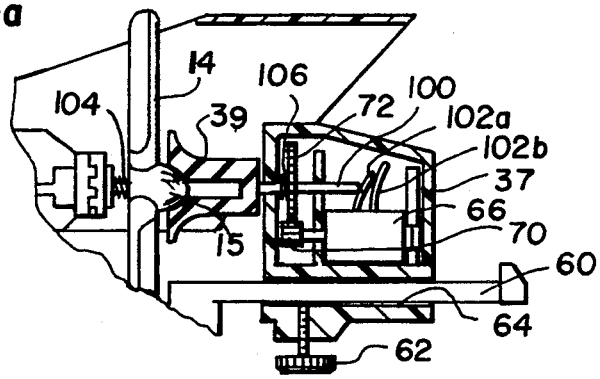

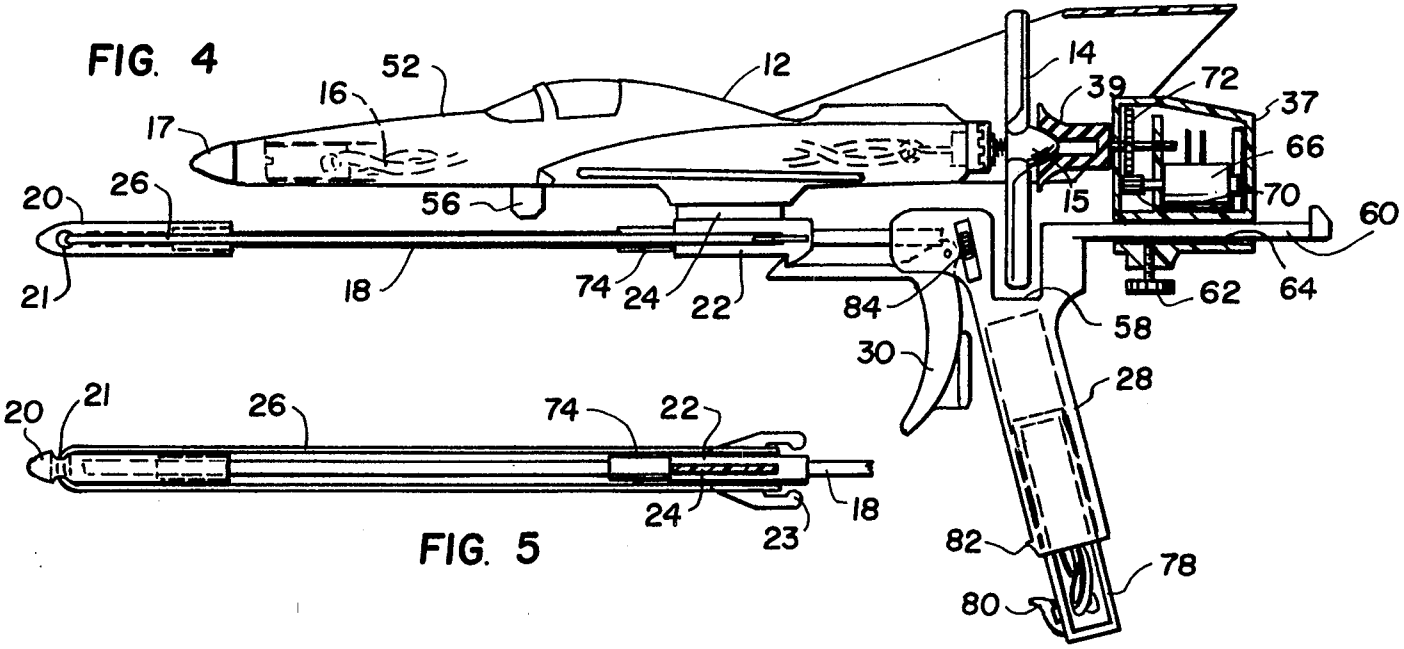
FIG. 4
FIG. 5
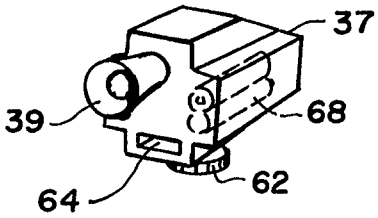
FIG. 6
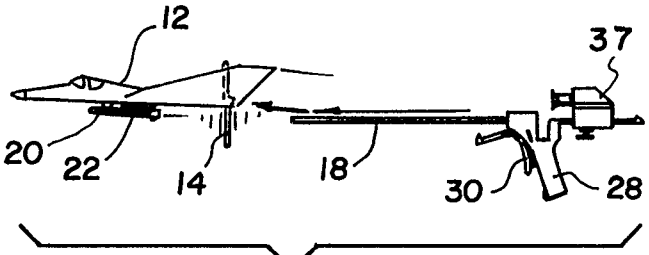
FIG. 7

TOY AIRPLANE LAUNCHER AND WINDER

CROSS REFERENCE TO RELATED APPLICATION

This is a continuation-in-part of Ser. No. 07/755,091, filed Sep. 5, 1991, now U.S. Pat. No. 5,129,852.

FIELD AND BACKGROUND OF THE INVENTION

The present invention relates in general to powered toy airplanes, and in particular to a new and useful launcher particularly for windup airplanes, which incorporates a winder mechanism.

U.S. Pat. No. 2,976,644 issued to the inventor of the present application, discloses a toy missile which incorporates a rubberband powered launcher. The missile which is advantageously in the form of an airplane, has a rear portion carrying wings and a tail section, and a forward portion which is separable from the rear portion. A plurality of rubberbands are engaged around hooks on the front and rear portions to hold the two portions of the airplane to each other. A bore extends completely to the rear portion of the aeroplane and extends as a blind bore into the forward section of the airplane. A launcher in the form of a handle, trigger and guide rod are used in conjunction with the airplane. To launch the airplane, the rod is inserted through the bore of the rear section and engaged into the blind bore of the front section. The rear section is then pulled rearwardly until it reaches a hook connected to the trigger. The separation between front and rear sections of the airplane stretch the rubberbands and prepare the airplane for launch. By pulling the trigger, the rear section is released and rapidly slides along the rod until it engages the front section. The forward momentum of the rear section then launches the entire airplane, including its front section, off the rod and into flight. The airplane may also include an onboard jet assist unit for lengthening the flight.

Prop-driven rubberband powered toy airplanes are also known. The prop is manually rotated to twist the rubberband which stores potential energy. Generally, the prop is released at the same time the airplane is thrown into the air to add some boost to the trust of the rotating prop. Although effective, this system is wasteful of the very limited energy which can be stored by the rubberband motor in that the propeller usually turns multiple times before the airplane is launched, thus losing the higher energy of the rubberband motor which is available in the first instant after the prop is released.

German Patent 516,945, dated Jan. 15, 1931, discloses a toy airplane launcher in the form of a spring loaded catapult. The propeller of the airplane is well clear of the catapult ramp, however, and it would spin even before the airplane is launched, thus losing much of its energy.

U.S. Pat. No. 2,731,769 discloses a propeller driven toy airplane with a rear battery operated winder on a launching platform having locking means for holding the toy airplane on the launcher until the propeller is spinning at a high enough speed for flight. There is no indication that the propeller should be powered by an onboard rubberband which is wound up, but rather rotation of the propeller is through a flywheel effect only.

U.S. Pat. No. 3,222,816 discloses a rubberband powered rear propeller flying toy which has no launching ramp but which can be wound up from the front. There is no indication that the propeller should be held against a launching guide during its launching operation, to maintain a full powered state until the flying toy is airborne. Before taking off, the flying toy of U.S. Pat. No. 3,222,816 has its propeller engaged against the ground. This will only momentarily restrain the propeller, however, and the flying toy will not be airborne until much energy from the wound rubberband has been lost.

U.S. Pat. No. 4,067,139 discloses the use of an onboard rechargeable battery in a toy airplane. No propeller restraining mechanism or launching structure is disclosed.

A need remains for a winding plus launching arrangement for toy airplanes, whether they are battery powered or rubberband powered, which launches the airplane into flight with force and in the correct direction, while minimizing loss of limited onboard energy for spinning the propeller.

SUMMARY OF THE INVENTION

An object of the present invention is to provide a self powered toy airplane and launcher combination which releases the airplane prop only after the airplane has cleared the launcher or, at the latest, at the instant when the airplane is released. The invention operates both with rubberband motor powered airplanes by incorporating a motor driven winder and launch assembly which both winds the prop and thereafter releases the prop only after the airplane has clear the launcher, or a battery powered charger which is engaged to charge batteries or other electric power storage means, up to the instant when the airplane is released.

Another feature of the present invention which improves the toy airplane's aerodynamic characteristics, is the use of a one or two percent down thrust position for the prop and a one or two percent side thrust position. The side thrust position is in a direction to compensate for counter-rotation of the airplane due to spinning torque of the prop. The down thrust position has been found to improve aerodynamic stability of the airplane.

Another feature of the invention which improves the aerodynamics of the airplane is the use of trim tabs on the elevator and on one of the wings. The trim tab on the single wing is also utilized to compensate for prop torque.

The wings may also include two bends each for giving the wings an inverted wing dihedral which gives the model airplane stability by forming a pocket of air under the wings on which the airplane floats.

A further important feature of the invention is the use of a clutch arrangement within the winder which winds the rubberband in a rubberband powered airplane, to its maximum permitted extent, and thereafter maintains this tension on the rubberband before the airplane is launched.

A further object of the invention is to mount the winder to the rear of the launcher for winding the rubberband both on a rear propeller and on a front propeller toy airplane.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 2*a* is a partial schematic view similar to FIG. 2, but utilizing a winder and launcher identical to the winder and launcher of FIG. 4, but used with a rear winding, front propeller airplane;

FIG. 2*b* is a sectional view taken along line 2*b*—2*b* of FIG. 2*a;*

FIG. 2*c* is a view similar to FIG. 2*a*, showing an alternate embodiment of the rear winding front propeller airplane;

FIG. 4 is a side elevational view similar to FIG. 1, partly in section and showing an alternate embodiment of the present invention;

FIG. 4*a* is an enlarged sectional view of the winder and rear portion of the toy airplane shown in FIG. 4;

FIG. 5 is a partial top plan view of the forward portion of the launcher of FIG. 4;

FIG. 6 is a perspective view of the winder of FIG. 4;

FIG. 7 is an exploded side elevational view showing the airplane just leaving the launcher of FIG. 4;

DESCRIPTION OF THE PREFERRED EMBODIMENTS

Figure 1:
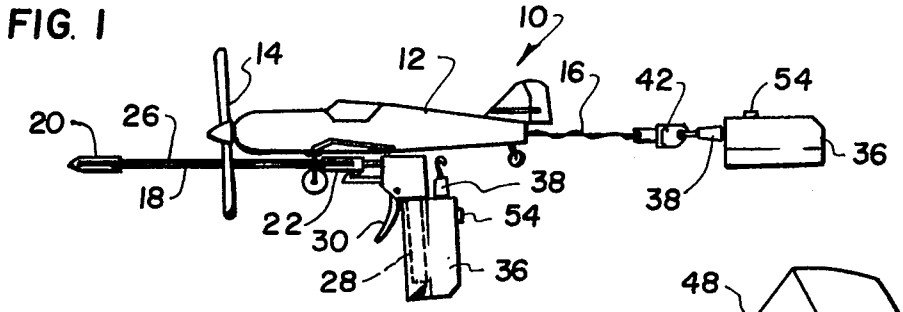
FIG. 1 is a side elevational view of an airplane with launcher and winder constructed in accordance with the present invention.
Figure 2:
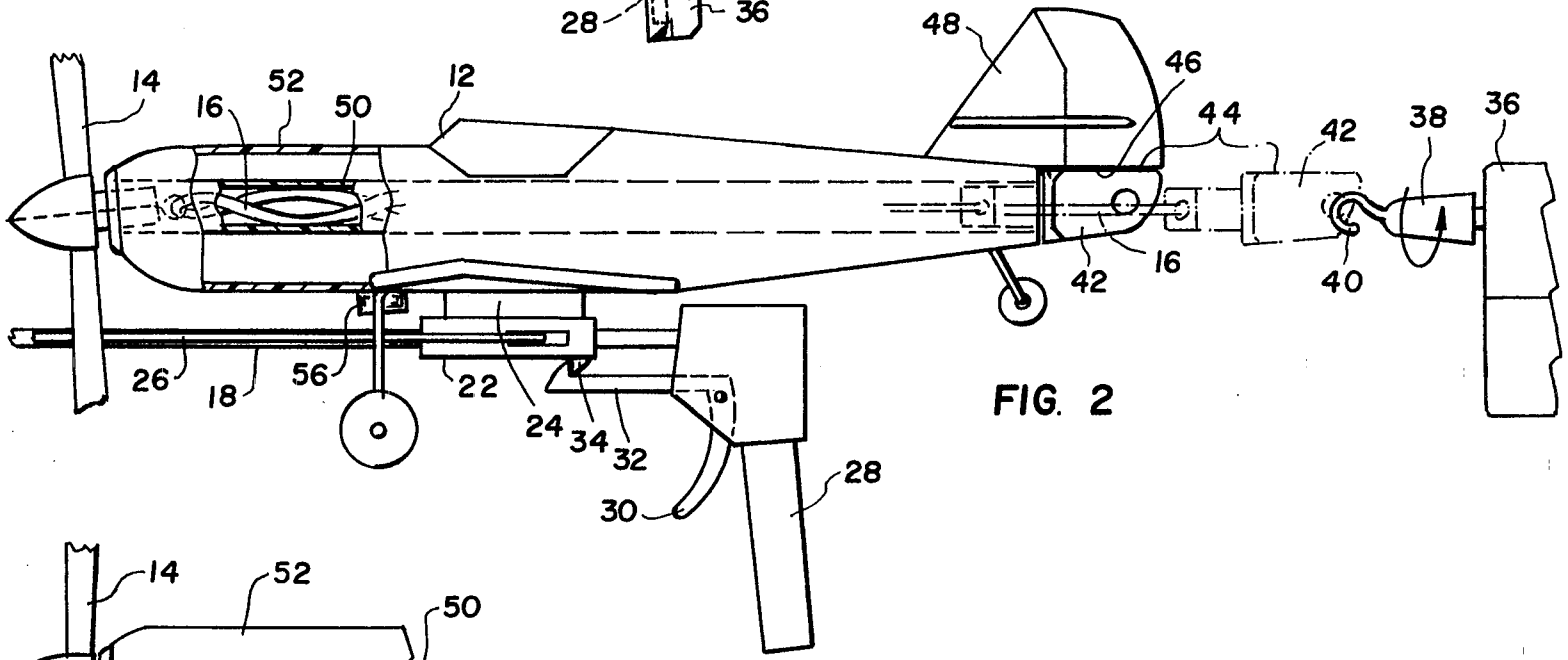
FIG. 2 is a partial enlarged view similar to FIG. 1.

Referring to the drawings in particular, the invention embodied in FIGS. 1 and 2 comprises a toy airplane launcher apparatus generally designated 10 having a toy airplane 12 with a prop 14 rotatably mounted thereto and energy storage means such as a rubberband motor 16 onboard the airplane for storing energy which can be released to the prop for rotating the prop.

Apparatus 10 also includes a launcher which comprises an elongated guide rail 18 with a front launcher section 20 detachably engaged to a front end of the rail. A rear launcher section 22 is engaged with and slidable along the guide rail 18 for movement into engagement with the front launcher section. The rear launcher section is fixed to the underside of the airplane fuselage 52 by a flat projection 24 best shown in FIG. 2.

Biasing means in the form of rubberbands 26 are engaged between the front and rear launcher sections 20, 22, on opposite sides of the launcher sections, for biasing the rear launcher section toward the front launcher section and providing the launching force for launching airplane 12 from the launcher.

A handle 28 is connected to a rear end of guide rail 18 and carries a spring loaded trigger 30 which is pivotally mounted to the handle. A release hook 32 which is fixed to the trigger 30 is engaged with a finger 34 of the rear launcher section 22 for retaining the rear launcher section in a rear cocked position, in preparation for launch.

In order to wind the rubberband motor 16 which forms energy storage means for rotating the prop, a battery operated winder 36 which includes a recess for closely receiving and thus being held on the handle 28, is disconnected from the handle. An internal motor and battery of conventional design (not shown) in winder 36 rotate a winding hub 38. Winding hub 38 includes a winding hook 40 which is engagable through a hole in a tail piece 42 having a flat upper surface 44 engagable under a corresponding flat surface 46 of a tail section 48 of the airplane 12. In FIG. 2, tail piece 42 in its solid line position is shown engaged under the tail section and thus precluded from rotation. Rubberband motor 16 is connected at one end to the tail piece 42 and is normally inside a support tube 50 positioned within a through hole in fuselage 52 of the airplane 12. When tail piece 42 is pulled from under the tail section as shown in FIG. 1, a switch 54 on winder 36 is moved to start rotation of hub 38 and thus wind up the rubberband motor 16. Since tail piece 42 is clear of tail section 48, it is free to rotate. Once sufficient winding has been completed to charge the rubberband motor, tail piece 42 is allowed to return to its position under tail section 48 where it is precluded from rotation by the engagement between flat surfaces 44 and 46. The winder 36 may then be returned to the handle 28 and the launcher prepared for launch. Prop 14, before the airplane is launched, has a rotation path which is intersected by guide rail 18 thus precluding the propeller from rotating.

When trigger 30 is pulled, rear launcher section 22 is released and moves rapidly under the influence of rubberbands 26 into engagement with front launcher section 20. Both launcher sections and the airplane thereafter leave the guide rail 18 and are launched into flight. Only after the prop 14 clears the guide rail 18, is it allowed to rotate, thus maximizing the launching speed and the amount of energy available to the airplane the instant it is launched. Since the front and rear launcher sections are under relatively large forces during the launching operation, a stopper 56 is placed under fuselage 52 to engage and cushion the front launcher section in case it is urged upwardly toward the fuselage under the large forces. Rubberbands 26 also serve to hold the front and rear launcher sections together during the flight.

FIGS. 2*a*–2*c* disclose a rear wound front propeller airplane which can use a winder and launcher to be described in connection with FIG. 4, but with a front propeller airplane. In FIG. 2*a*, this is done by providing a tailpiece 43 having a conical or rounded rear surface that can be engaged into the winding hub 39 and rotated due to frictional engagement between the rubber hub and the rigid tailpiece. Rotation in the clockwise direction shown by the arrow 41 in FIG. 2*b*, is possible since a radial projection 45 which extends outwardly from the tailpiece 43 can pass a flipper 47 pivotally mounted to a rear airplane hub 49 fixed to the fuselage of the airplane. Upward pivoting of flipper 47 is permitted to a small extent until it engages an inclined step 49*a* in a recess of hub 49. This movement is enough to allow the radial projection to pass. Rotation in the opposite direction is not possible, however, since projection 45 will push flipper 47 against an axially step 49*b* in the recess, precluding downward pivoting of the flipper.

Winding of the rubberband in the front propeller airplane will continue until the rear rubberband shaft 51 pulls the tailpiece 43 toward the airplane fuselage against the biasing force of a spring 55. This will disengage the tail piece 43 from the rubber hub 39 sufficiently to stop the winding action. Frictional engagement will be maintained however if the rubberband tries to unwind, since the tension on the rubberband will be at equilibrium with the frictional engagement between parts 43, 39 and with the biasing force of spring 55. This fully wound and static condition can be maintained long enough to aim the airplane and launch it from the launcher by pulling the trigger which will be explained in connection with FIG. 4.

FIG. 2*c* shows an alternate rear winding arrangement where the clutch between the tailpiece 43 and the airplane hub 49 is achieved by an inclined ramp 49*c* along which an axial projection 45 may ride in one direction. Rotation in the opposite direction is stopped since the projection 45 engages a stop surface 49*d*.

Figure 3:
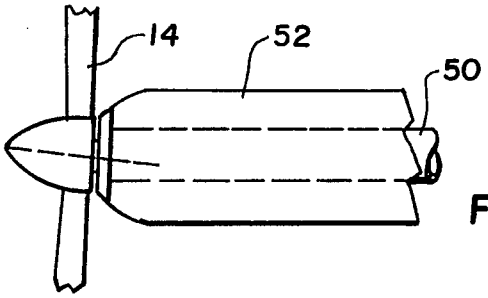
FIG. 3 is a partial top plan view of the forward part of the airplane shown in FIG. 2.

To improve the flying characteristics of the airplane and compensate for torque which tends to turn the airplane in a direction opposite to the direction of rotation of prop 14, the prop is mounted at a one or two percent side thrust as shown in FIG. 3, which represents approximately a one or two degree angle for the axis of rotation of the prop 14 with respect to the main axis of the fuselage 52. As shown in FIG. 2, prop 14 is also mounted at a one or two percent down thrust with respect to the main axis of the fuselage. This has been found to improve flight characteristics particularly under the large launching forces and subsequent self propelled forces experienced by the airplane.

In the remaining figures, the same reference numerals are utilizes to designate the same or functionally similar parts.

In the embodiment of FIG. 4, prop 14 is a so-called "push-prop" and is rotatably mounted to the rear of the fuselage 52. Handle 28 connected to the rear end of guide rail 18 includes a U-shaped prop well 58 which receives the path of rotation for prop 14 when the rear launcher section 22 is engaged with the trigger 30. In this position, a spinner 15 of prop 14 is fractionally engaged with a rubberband winding hub 39 which is mounted for rotation to a winder 37 which is positioned at adjustable fixed locations along a rear projection 60 extending rearwardly of handle 28. A housing of winder 37 includes an opening 64 which receives the rear projection 60. In operation, a set screw 62 is loosened and the winder housing is moved to the left in FIG. 4 until hub 39 fractionally engages spinner 15. In this position, screw 62 is tightened to fix the winder in place. Hub 39 has a funnel shaped inlet to help center the spinner 15 in the hub.

A motor 66 in the winder 37 is powered by batteries 68 (see FIG. 6) and, through a pinion gear 70 connected to the motor shaft and a large spur gear 72 meshed with the pinion gear and fixed to the hub 39, rotates the prop for winding the rubberband motor 16. Winding continues until the frictional engagement is overcome and a static torque condition is established between hub 39 which continues to spin and prop 14 which is held to keep the rubberband motor wound. During this steady state condition, trigger 30 is pulled to release the rear launcher section 22 which, by the biasing of rubberband 26, moves forwardly quickly to engage the front launcher section 20 which, together with the airplane, leave the guide rail 18. While airplane 12 moves along the guide rail, prop 14 is prevented from turning since it immediately rotates against guide rail 18 after it leaves well 58, until the prop clears the guide rail as shown in FIG. 7. Just as in the embodiment of FIG. 1, thus the airplane has a fully charged or wound motor, the moment it leaves the launcher.

In FIG. 4, rear launcher section is shown to include a cylindrical post 74 which engages into a cylindrical blind bore in front section 20, to further strengthen the engagement between the launcher sections after the airplane has been launched. Alternatively, post 74 can be conical and fit into a conical blind bore in front section 20, to further render the engagement between the front and rear launcher sections secure and rigid for flight.

Handle 28 also includes a storage drawer 78 which may contain extra rubberbands and the like, and which can be slid up into the hollow handle 28 and held in place by a clip 80 snapped onto a finger 82.

The embodiment of FIGS. 4 and 5 also use a single rubberband 26 which is looped through a hole 21 in the front launcher section 20, with opposite ends of the rubberband being hooked around a pair of hooks 23 fixed to the sides of rear launcher section 22. Handle 28 also includes a safety lock 84 which prevents trigger 30 from moving until the safety lock is lowered. Airplane 12 also has a rubber tip 17 for safety.

As noted previously in this disclosure, the winder and launching of FIG. 4 can be used with a rear wound but front propeller airplane such as that shown in FIGS. 2*a*, 2*b* and 2*c*.

FIG. 4*a* shows a power disconnect feature of the invention which can be used in the winder of FIG. 4 and the winder of FIG. 2*a*.

FIG. 4*a* is a partial and exploded section of FIG. 4, showing the motor in its activated condition with contacts 102*a* and 102*b* touching each other. The contacts are in the form of leaf springs which are pushed rearwardly by the rear portion of shaft 100 to which gear 72 is fixed. Gear 72 and shaft 100 slide rearwardly and along gear 70, against the bias of a spring 106, to establish contact for closing the circuit that powers motor 66 by having contacts 102*a* and 102*b* touch. Motor 66 rotates gear 70 which in turn rotates shaft 100 and hub 39, only when the contacts are touching each other. When the rubberband 16 in FIG. 4, is wound to the extent that it pulls back on the propeller with its tail piece 15, a further spring 104 is compressed. This causes spring 106 to push hub 39 forwardly and to disconnect contacts 102*a* and 102*b*, to interrupt power to the motor. In this condition, the tendency of the propeller hub 15 to rotate under the influence of its wound rubberband 16, is resisted by the frictional contact between the hub and hub 39 and the resistance of the gears 70, 72 in the motor 66. In this static but steady state condition, the rubberbands 16 is fully wound, waiting for the trigger 30 to be pulled which releases the airplane so that it can ride along the guide for launch. As soon as the propeller leaves its engagement with hub 39, the rubberband would normally cause the propeller to rotate. This rotation is stopped, however, by the fact that the blades of the propeller engage the guide 18, preventing rotation until the airplane has cleared the guide.

Figure 9:
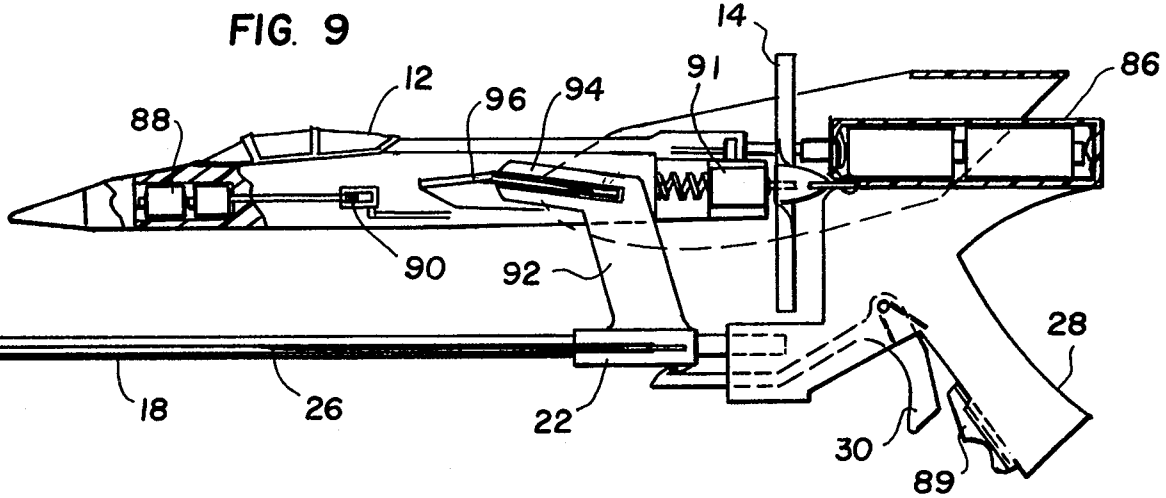
FIG. 9 is a side elevational view of FIG. 8.
Figure 8:
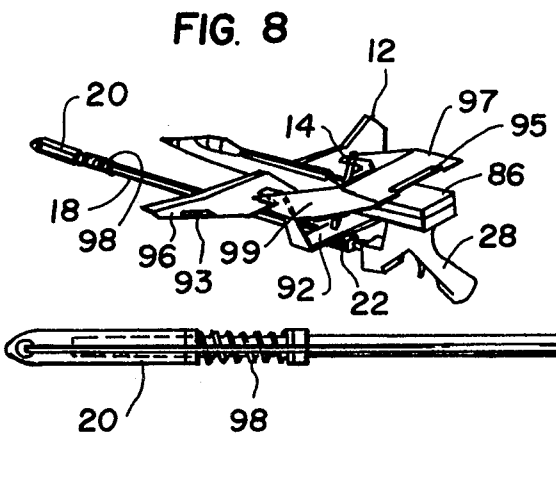
FIG. 8 is a perspective view of a further embodiment of the invention including an airplane, a launcher and a charger.
Figure 10:
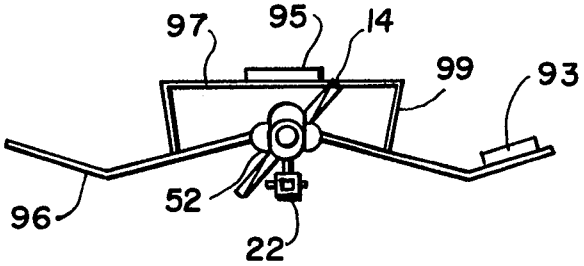
FIG. 10 is a front elevational view of a airplane illustrating a further embodiment of the invention.

FIGS. 8 through 10 illustrate a further embodiment of the invention where a battery charger 86 containing a plurality of large batteries is detachably connected to electrical contacts at the rear of an airplane 12 which contains smaller rechargeable batteries 88 which are connected by a switch 90 to an onboard motor 91 for rotating the prop 14. In this embodiment of the invention, the charging means comprise an electrical charging arrangement rather than a rubberband motor winder. The central characteristic of the invention remains the same in that maximum energy storage is desired at the moment the airplane is launched.

The embodiment of FIG. 9 also differs in that the front launcher section 20 is fixed to the front end of guide rail 18 while the rear launcher section 22 is detachably engaged to the airplane. For this purpose, rear launcher section 22 includes a support 92 with a pair of upwardly extending fins which have upper slots 94 that engage rear edges of the wings 96 of airplane 12. When trigger 30 is pulled, rear launcher section 22 is released and, through the influence of rubberband 26, moves rapidly into engagement with front launcher section 20. Both launcher sections remain on the guide to 18 while the airplane is launched. To buffer the engagement between the launcher sections, a shock absorbing spring 98 is connected to the rear end of front section 20.

A safety block 89 is slidably mounted to the front surface of handle 28 to be upwardly slid behind trigger 30 to prevent its being pulled until ready.

Contacts between the charger 86 and the battery 88 are at the rear of the airplane fuselage and automatically disconnect when the airplane is launched. Alternately, they may incorporate a switch which automatically connects motor 91 to batteries 88 when the airplane is launched. Switch 90 is used as an overall power switch to open or close the circuit between the batteries and motor. Instead of batteries 88, other electrical storage means may be utilized such as capacitors.

FIG. 10 is a front elevational view of an airplane which can be used with the launchers of the present invention. It includes a fuselage 52 having wings 96 connected to opposite sides of the fuselage and bent into an inverted wing dihedral which has been found to stabilize the airplane's flight as it floats over a pocket of air formed under the wings. The airplane of FIG. 10 includes a one piece tail section 99 with an elevator 97 having a bendable trim tab 95. At least one wing 96 is also provided with a bendable trim tab 93 which is bent to counteract the torque of prop 14. This has been found to maintain straight flight when the airplane is launched.

Figure 11:
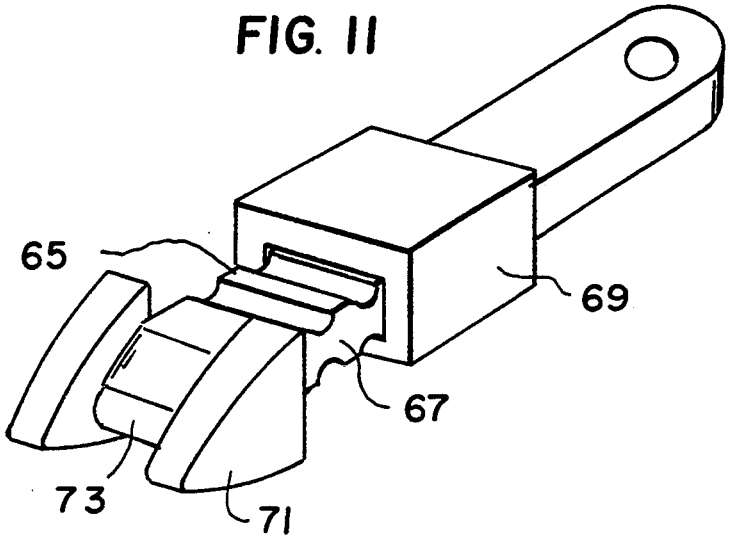
FIG. 11 is a perspective view of a rear rubber motor connector for use of heavy duty non-looped rubber strips as the rubberband motors.
Figure 12:
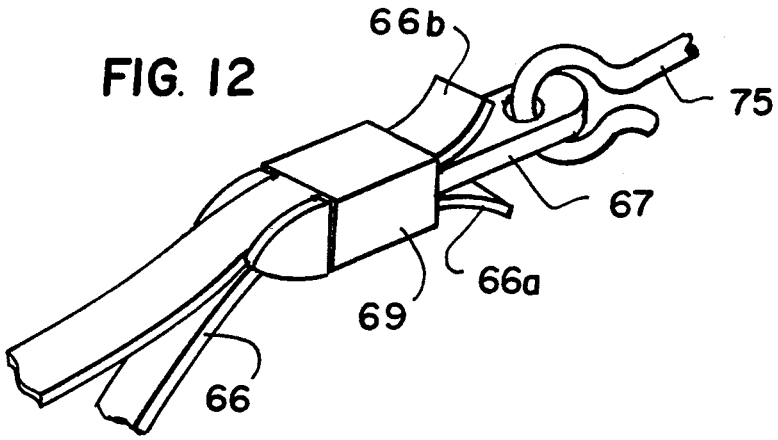
FIG. 12 is a view similar to FIG. 11, but with a rubberband strip attached.

FIGS. 11 and 12 show another improvement of the invention, this improvement being in the rubberband motor. In order to use open ended heavy duty rubber strips as the rubberband motor, the free ends **66*a* and 66*b* of the rubber strip 66 can be captured over the top and under the bottom of a plug 67 captured within a strip connector 69 having a rectangular opening for receiving the plug 67 and for squeezing the ends 66*a*, 66*b* of the rubber strip. An enlarged forward end 71 of the plug 67 smoothly receives the rubberband strip ends over and under a rounded ramp 73 between side walls which confine the rubber strip 66 in a specific location as shown in FIG. 12. A winding hook 75 connected to the winding shaft in any of the other embodiments of the invention, can be used in conjunction with plug 67**.

Upper and lower ridges 65 on the plug 67 frictionally engage the rubber strip, retaining it within the connector 69. Rubber strip 66 is flat and ribbon-shaped so that its ends lie flat against the rounded ramp 73, between the enlarged side walls of the plug.

While specific embodiments of the invention have been shown and described in detail to illustrate the application of the principles of the invention, it will be understood that the invention may be embodied otherwise without departing from such principles.

What is claimed is:

1. A toy airplane plus launcher apparatus, comprising:

a toy airplane;

a prop mounted for rotation to said airplane and in a path;

energy storage means onboard said airplane for storing energy which is releasable to said prop for rotating said prop to propel said airplane;

a launcher guide rail;

a front launcher section engaged to a front end of said guide rail;

a rear launcher section engaged with and slidable along said rail for movement into engagement with said front launcher section, said rear launcher section being engaged with said airplane for moving said airplane along said guide rail with movement of said rear launcher section, said path being intersected by said guide rail as said airplane moves with said rear launcher section along said guide rail, for preventing said prop from rotating until said airplane has left said guide rail;

biasing means connected between said front and rear launcher sections for urging said rear launcher section toward said front launcher section;

trigger means movably mounted to said guide rail and engageable with said rear launcher section for retaining said rear launcher section at a spaced location away from said front launcher section, and for releasing said rear launcher section with movement of said trigger means so that said rear launcher section moves toward said front launcher section under the influence of said biasing means;

charging means connected to said energy storage means for storing energy in said energy storage means, so that when the trigger means is moved, the airplane is launcher with full energy storage in said energy storage means until the airplane leaves the guide rail whereupon the prop is allowed to rotate, having cleared the guide rail, the airplane being launched in proper direction by aiming the guide rail and with full power for prolonged flight;

said energy storage means comprising a resilient member connected to said prop and windable to store energy for rotation of said prop, said charging means comprising a winder detachably connected to said resilient member for winding said resilient member;

said winder being fixable to said guide rail, said winder having a rotatable hub engageable with said prop for winding said prop to wind said resilient member, said prop being disengaged from said hub when said trigger means is moved to move said rear launcher section with said airplane away from said hub; and clutch means for deactivating the winder when the resilient member has been wound to a maximum extent.

2. An apparatus according to claim 1, wherein said winder comprises a motor, at least one battery, a switch comprising two contacts connected between said motor and said battery, a shaft connected to said hub and axially movable for engaging said contacts to close said contacts to activate the motor, said airplane including a winding shaft engaged with the resilient member for winding the resilient member With rotation of the shaft, the airplane including a tail piece connected to the shaft and a spring engaged with the shaft for biasing the tail piece toward the rotatable hub, winding of the resilient member causing, squeezing of the spring to move the tail piece away from the hub and stop winding action while opening the contacts to deactivate the motor.

3. An apparatus according to claim 1, wherein said clutch means comprises a tail piece operatively connected to the resilient member and mounted for rotation to a rear of the toy airplane, the prop being mounted to a front end of the airplane and connected through the resilient member to the tailpiece, and means for allowing the tail piece to rotate in a winding direction only.

4. An apparatus according to claim 3, wherein the means for allowing rotation of the tail piece in a winding direction only comprises a flipper rotatably mounted to the rear of the airplane for rotation in one direction only, and a projection on the tail piece for engaging the flipper and for allowing it to pivot in one direction, engagement of the projection with the flipper with rotation of the tail piece in an opposite direction, stopping rotation of the tail piece in the opposite direction.

5. An apparatus according to claim 3, wherein the means for preventing rotation of the tail piece in an opposite direction comprises a ramp and step connected to the rear of the airplane, the tail piece having a projection for movement along the ramp in a winding direction of rotation for the tail piece, and for stopping against the step in an opposite direction of rotation.

6. A connector assembly for connecting a resilient member having opposite free ends for use as an energy storage mechanism for rotating a propeller in a toy airplane, comprising:

a flat ribbon-shaped rubber strip having opposite free ends and defining a resilient member;

a plug having a rectangular cross section with a plurality of upper and lower projections;

a connector having a rectangular opening for receiving the plug, opposite ends of the resilient member lying flat over and under the plug and between the plug and the connector over and under the projections for holding the resilient member ends to the plug; and a front end portion of the plug having a rounded upper and lower surface forming ramps for the free ends of the resilient member which lie flat on the ramps, and enlarged sides on either side of the front end for restraining the resilient member ends laterally.

7. A toy airplane plus launcher apparatus, comprising:

a toy airplane;

a prop mounted for rotation to said airplane and in a path;

energy storage means onboard said airplane for storing energy which is releasable to said prop for rotating said prop to propel said airplane;

a launcher guide rail;

a front launcher section engaged to a front end of said guide rail;

a rear launcher section engaged with and slidable along said rail for movement into engagement with said front launcher section, said rear launcher section being engaged with said airplane for moving said airplane along said guide rail with movement of said rear launcher section, said path being intersected by said guide rail as said airplane moves with said rear launcher section along said guide rail, for preventing said prop from rotating until said airplane has left said guide rail;

biasing means connected between said front and rear launcher sections for urging said rear launcher section toward said front launcher section;

trigger means movably mounted to said guide rail and engageable with said rear launcher section for retaining said rear launcher section at a spaced location away from said front launcher section, and for releasing said rear launcher section with movement of said trigger means so that said rear launcher section moves toward said front launcher section under the influence of said biasing means;

charging means connected to said energy storage means for storing energy in said energy storage means, so that when the trigger means is moved, the airplane is launcher with full energy storage in said energy storage means until the airplane leaves the guide rail whereupon the prop is allowed to rotate, having cleared the guide rail, the airplane being launched in proper direction by aiming the guide rail and with full power for prolonged flight;

said energy storage means comprising a resilient member connected to said prop and windable to store energy for rotation of said prop, said charging means comprising a winder detachably connected to said resilient member for winding said resilient member; and a winding shaft connected to the resilient member and rotatable by the winder, a plug engaged to the winding shaft having at least one projection, the resilient member having opposite free ends which are engaged over and under the plug, and a connector engaged over the plug and over the opposite ends of the resilient member for holding the resilient member to the plug.

* * * * *